United States Patent [19]

Tang

[11] Patent Number: 4,835,864

[45] Date of Patent: Jun. 6, 1989

[54] COMBINATION FORK/SPOON UTENSIL

[76] Inventor: Hua H. Tang, 1511 S. Los Robles Ave., Pasadena, Calif. 91106

[21] Appl. No.: 159,112

[22] Filed: Feb. 22, 1988

[51] Int. Cl.[4] ..... A47J 43/28

[52] U.S. Cl. ..... 30/150; 30/122; 30/322; 30/324

[58] Field of Search ..... 30/122, 137, 142, 147, 30/150, 322, 324–328

[56] References Cited

U.S. PATENT DOCUMENTS

| | | | |
|---|---|---|---|
| 172,988 | 1/1876 | Flagg . | |
| 212,044 | 2/1879 | Nott . | |
| 1,044,869 | 11/1912 | Emmenegger . | |
| 1,271,679 | 7/1918 | Duckett . | |
| 1,348,762 | 8/1920 | Suzuki | 30/122 |
| 1,351,045 | 8/1920 | Larson . | |
| 1,351,046 | 8/1920 | Larson . | |
| 1,603,286 | 10/1926 | Larson . | |
| 2,216,005 | 9/1940 | Goldstein | 30/150 X |
| 2,291,981 | 8/1942 | Neururer . | |
| 2,840,414 | 6/1958 | Le Beau . | |
| 3,967,376 | 7/1976 | Foley | 30/150 |
| 4,524,512 | 6/1985 | Formo et al. | 30/150 X |

*Primary Examiner*—Frank T. Yost
*Assistant Examiner*—Michael D. Folkerts
*Attorney, Agent, or Firm*—Sheldon & Mak

[57] ABSTRACT

A combination utensil capable of being alternatively used as a fork and a spoon. The utensil comprises (a) an elongate handle, (b) a spoon-shaped head attached to the handle, and (c) a movable plate. The spoon-shaped head has a cut out portion at its forward end. The cut out portion provides at least two tines. The plate is capable of being moved between two positions. In one position, the plate substantially covers the cut out portion of the head and the utensil forms a spoon. In the other position, the cut out portion of the head is substantially uncovered and the utensil forms a fork.

13 Claims, 1 Drawing Sheet

COMBINATION FORK/SPOON UTENSIL

BACKGROUND

The present invention is directed to a convertible utensil capable of being used a fork or spoon.

Present society is characterized by a mobile, convenience oriented population having an affinity for compact, low cost, easy to use, and disposable products. This is especially true for camping, picnicking, and similar outdoor activities. However, to take part in these outdoor activities requires suitable eating utensils. Although low cost and disposable forks, spoons, and knives are available, these forks, spoons, and knives are separate articles and increase the bulk that must be carried to these activities. Accordingly, there is a need for eating utensils, such as forks and spoons, which are compact and convenient in addition to being low cost and disposable.

SUMMARY the present invention satisfies this need by providing a utensil that is capable of being used as a spoon or a fork. The combined fork/spoon utensil is compact, convenient, low cost, and disposable.

According to the invention, the convertible utensil comprises an elongated handle and a spoon-shaped head attached thereto. At the forward end of the spoon-shaped head is a cut out portion which provides at least two tines. The convertible utensil also comprises a movable plate. The plate can be moved to a first position so that the plate substantially covers the cut out portion of the head. When the plate is in the first position, the utensil forms a spoon. The plate can also be moved to a second position so that the cut out portion of the head is substantially uncovered. When the plate is in the second position, the utensil forms a fork. In one embodiment of the present invention, the plate is placed in the first or second position by being moved along the longitudinal axis of the utensil.

Optionally, the inner surface of each tine can have a longitudinal groove therein for either guiding the movement of the plate between the first and second positions and/or for forming a liquid impervious seal with the plate when the plate is in the first position and the utensil forms a spoon.

In a preferred embodiment of the present invention, the spoon-shaped head has a slot therein for housing and guiding the plate. The slot is in communication with the cut out portion of the head. In this embodiment of the invention, the plate is movably positioned within the slot.

The elongated handle and spoon-shaped head can be connected by a neck. The neck can have a longitudinal slot therein. The longitudinal slots in the neck and in the spoon-shaped head are in communication with one another. Optionally, at least one surface of the neck is formed to provide a second slot which intersects at least a portion of the first slot in the neck. For example, the second slot can be located at either the bottom surface or a side surface of the neck. In addition, the utensil can further comprise means for moving the plate between the first and second positions. The movement means, e.g., a tab, can be attached to the plate and positioned in the groove.

The cut out portion of the spoon-shaped head can provide two outer tines and at least one inner tine. The inner tines can be attached to the spoon-shaped head either above, below, or across the first slot. When the inner tines are attached above the first slot and when the plate is in the forward position, the top surface of the plate faces the bottom surface of each inner tine. When the inner tines are attached to the spoon-shaped head below the first slot in the spoon-shaped head and when the plate is in the forward position, the bottom surface of the plate faces the top surface of the inner tines. However, when the inner tines are attached to the spoon-shaped head above and below the first slot, the plate has at least one longitudinal forward recess therein wherein each recess in the plate corresponds to an inner tine so that each inner tine serves as a guide as the plate moves between the two positions.

DRAWINGS

These and other features, aspects, and advantages of the present invention will become better understood with reference to the following description, appended claims, and accompanying drawings, where:

DESCRIPTION

The present invention is directed to a convertible utensil capable of being used as a fork or spoon. The combination fork/spoon utensil of this invention fulfills the needs of a mobile, outdoor loving, convenience oriented society for a compact, low cost, convenient, and disposable eating utensil.

Figure 8:
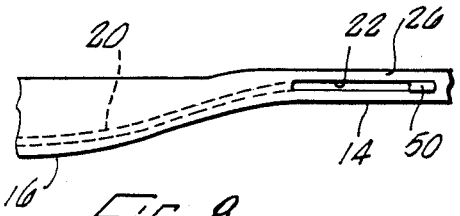
FIG. 8 is a fragmentary side plan view of the configuration of the utensil of FIG. 7.
Figure 7:
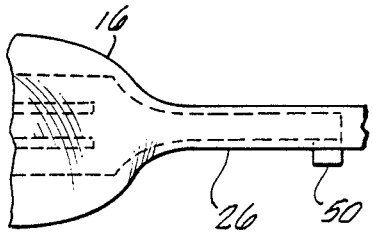
FIG. 7 is a fragmentary plan view of an alternate configuration of the utensil of FIG. 1.
Figure 2:
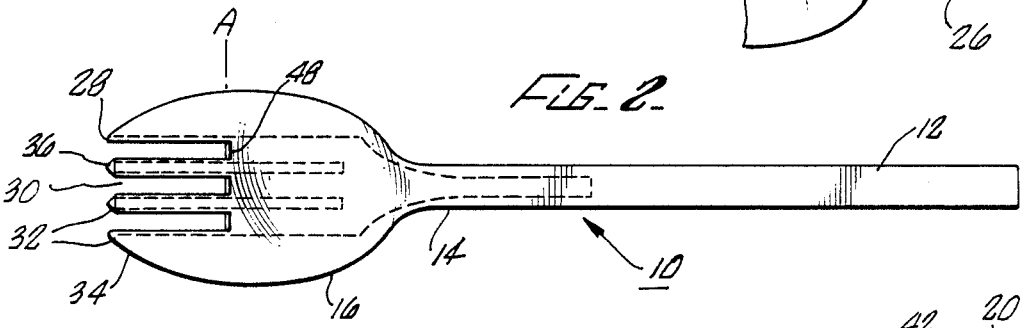
FIG. 2 is a top plan view of the utensil of FIG. 1.
Figure 5:
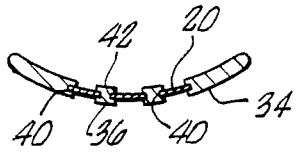
FIG. 5 is a transverse, sectional elevational view of a spoon-shaped head portion of the utensil of FIG. 1 along line 5—5 of FIG. 3.
Figure 3:
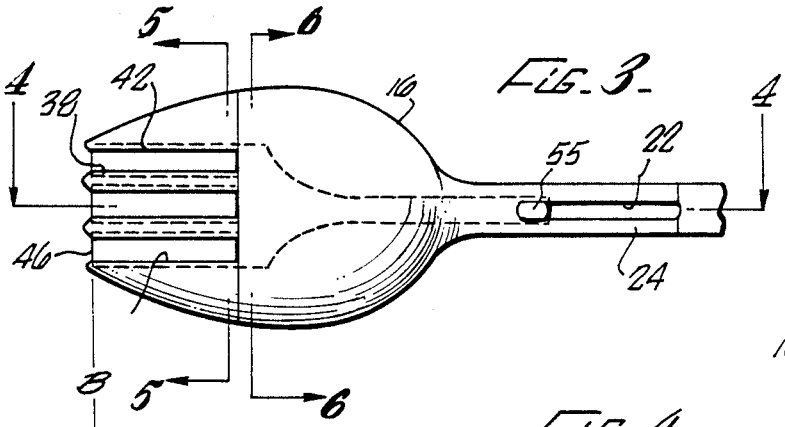
FIG. 3 is a fragmentary bottom plan view of the utensil of FIG. 1.
Figure 6:
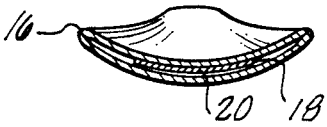
FIG. 6 is a transverse, sectional, elevational view of a spoon-shaped head portion of the utensil of FIG. 1 along line 6—6 of FIG. 3.
Figure 4:
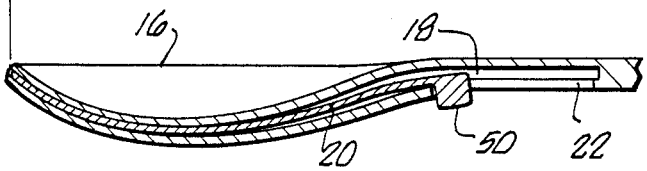
FIG. 4 is a fragmentary longitudinal, sectional, elevational view of the utensil of FIG. 1 along line 4—4 of FIG. 3.

With reference to the figures, the present invention provides a convertible utensil 10 capable of being used as a fork or spoon. The utensil 10 includes an elongate handle 12. A neck 14 extends rigidly from the handle 12 for rigidly supporting a spoon-shaped head 16, further described below. The neck 14, and a portion of the head 16, has a transverse first slot 18 therein for receiving a plate 20 as described below. A longitudinal second slot 22 in a bottom surface 24 of the neck 14 intersects at least a portion of the first slot 18. Alternatively, as shown in FIGS. 7 and 8, the second slot 22 can be located in a side surface 26 of the neck 14.

A forward end 28 of the spoon-shaped head 16 has a cut out portion 30 which provides at least two tines 32. In general, the cut out portion 30 provides two outer tines 34 and at least one inner tine 36. An exemplary configuration of the utensil 10 has two outer tines 34 and two inner tines 36, as shown in the drawings.

The first slot 18 is in communication with the cut out portion 30 of the spoon-shaped head 16. The inner tines 36 are formed in the spoon-shaped head 16 above and below the first slot 18. Alternatively, the inner tines 36 include only one of the portions above and below the first slot 18. A side surface 38 of each outer tine 34 and inner tine 36 preferably has a longitudinal groove 40 therein for guiding and supporting a tine portion 42 of the plate 20.

When the inner tine 36 is formed in the spoon-shaped head 16 above and below the first slot 18, the plate 20 has one or more longitudinal, forward recesses 44 therein. Each recess 44 corresponds to an inner tine 36. The plate 20 is slidingly supported in the first slot 18 for longitudinal movement between a first position A and a second position B. In the first position A, an outer edge 46 of the plate 20 is proximate the forward end 28 of the spoon-shaped head 16. Accordingly, in the first position A, the plate 20 substantially closes the cut out portion 30, the longitudinal grooves 40 forming a substantially liquid impervious seal with the plate 20, and the utensil 10 thereby forms a spoon.

In the second position B of the plate 20, the outer edge 46 is proximate an inner end 48 of the cut out portion 30 of the spoon-shaped head 16. Accordingly, in the second position B, the cut out portion 30 of the spoon-shaped head 16 is substantially exposed and the utensil 10 thereby forms a fork.

Optionally, the utensil 10 can further comprise means 50 for moving the plate 20 between the first and second positions A and B, respectively. The movement means 50 is attached to the plate 20 and protrudes the second slot 22, forming a tab.

Figure 1:
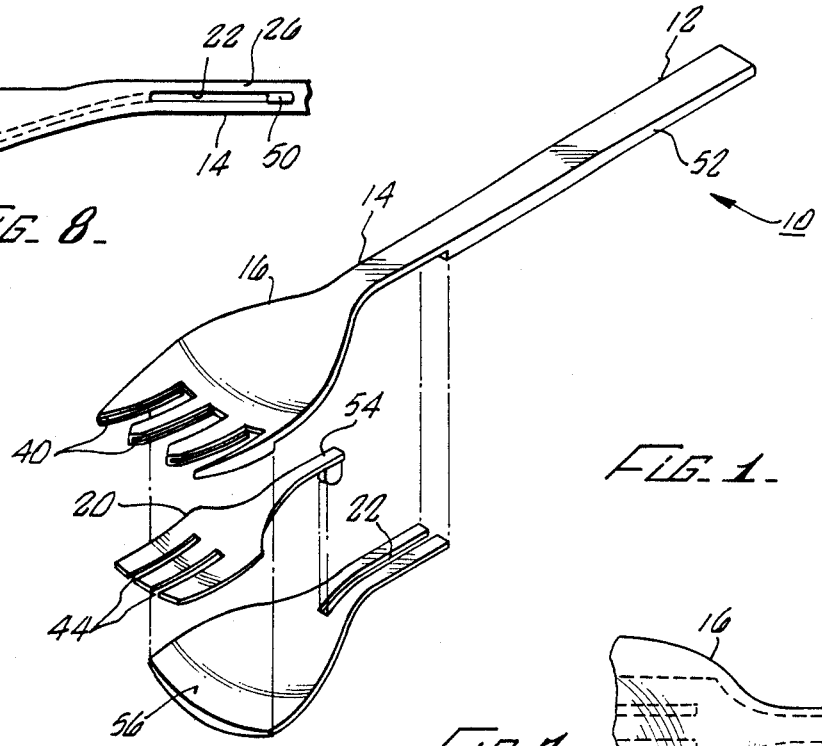
FIG. 1 is an exploded view of a convertible fork/-spoon utensil embodying features of the present invention.

The utensil 10 can be conveniently made of plastic. For example, as shown in FIG. 1, the utensil 10 can be assembled from three component parts 52, 54, and 56. The first part 52 comprises the bulk of the handle 12, neck 14, and the spoon-shaped head 16. The second part 54 comprises the plate 20 and the movement means 50. The third part 56 comprises a portion of the backside of the neck 14 and a portion of the back side of the spoon-shaped head 16. Each of these parts 52, 54, and 56 can be injection molded and subsequently assembled. The third part 56 can be attached to the first part 52 by a suitable adhesive means such as epoxy.

The convertible utensil 10 can be used as a spoon by placing the plate 20 in a first position A and can be used as a fork by moving the plate 20 to the second position B. Accordingly, the convertible utensil 10 is convenient, compact, and low cost. After use, the convertible utensil 10 can either be disposed of or cleaned.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A convertible utensil capable of being used as a fork or spoon, the utensil comprising:
(a) an elongated handle;
(b) a spoon-shaped head attached to the handle, the head having at its forward end a cut out portion providing at least two tines, and the head having a slot therein, the slot being in communication with the cut out portion of the head; and
(c) a movable plate movably positioned within the slot, the plate being capable of being moved to (i) a first position so that the plate substantially covers the cut out portion of the head, the utensil thereby forming a spoon, and (ii) a second position so that the cut out portion of the head is substantially uncovered, the utensil thereby forming a fork.

2. A convertible utensil capable of being used as a fork or spoon, the utensil comprising:
(a) an elongated handle having a neck member rigidly extending therefrom;
(b) a spoon-shaped head attached to the neck, the head having at its forward end a cut out portion providing at least two tines;
(c) the neck member and a rear portion of the spoon-shaped head being formed to provide a first transverse slot, the first transverse slot being in communication with the cut out portion of the head;
(d) a plate movably positioned in the first slot, the plate being capable of longitudinal movement between first and second positions, wherein (i) in the first position an outer edge of the plate is proximate to the forward end of the head, the plate thereby substantially closing the cut out portion and the utensil thereby forming a spoon and (ii) in the second position the outer edge of the plate is proximate the inward end of the cut out portion of the spoon-shaped head, the cut out portion of the head thereby being substantially exposed and the utensil thereby forming a fork.

3. The utensil of claim 2 wherein:
(a) at least one surface of the neck member is formed to provide a second longitudinal slot therein, the second slot intersecting at least a portion of the first slot; and
(b) the utensil further comprises means for moving the plate between the first and second position, the means being attached to the plate and positioned in the second slot.

4. The utensil of claim 3 wherein the second slot is located at the bottom surface of the neck.

5. The utensil of claim 3 wherein the second slot is located at a side surface of the neck.

6. The utensil of claim 2 wherein the cut out portion of the head comprises two outer tines and at least one inner tine.

7. The utensil of claim 6 wherein each inner tine is attached to the spoon-shaped head above the first slot so that the top surface of the plate faces the bottom surface of each inner tine when the plate is in the forward position.

8. The utensil of claim 6 wherein each inner tine is attached to the spoon-shaped head below the first slot so that the bottom surface of the plate faces the top surface of each inner tine when the plate is in the forward position.

9. The utensil of claim 6 wherein:
(a) each inner tine is attached to the spoon-shaped head above and below the second longitudinal slot; and
(b) the plate has at least one longitudinal forward recess therein, each recess in the plate corresponding to an inner tine so that each inner tine serves as a guide as the plate longitudinally moves between the two positions.

10. The utensil of claim 9 wherein each inner surface of the tines has a longitudinal groove therein for guiding the longitudinal movement of the plate between the first and second positions.

11. The utensil of claim 9 wherein each inner surface of the tines has a longitudinal groove therein for forming a substantially liquid impervious seal with the plate when the plate is in the first position and the utensil forms a spoon.

12. The utensil of claim 9 wherein each inner surface of the tines has a longitudinal groove therein (i) for guiding the longitudinal movement of the plate between the first and second positions and (ii) for forming a substantially liquid impervious seal with the plate when the plate is in the first position and the utensil forms a spoon.

13. A convertible utensil capable of being used as a fork or spoon, the utensil comprising:

(a) an elongate handle having a neck member rigidly extending therefrom:

(b) a spoon-shaped head attached to the neck, the head having at its forward end a cut out portion providing two outer tines and two inner tines;

(c) the neck member and a rear portion of the spoon-shaped head being formed to provide a transverse slot and a side surface of the neck member being formed to provide a second longitudinal slot, the second slot intersecting at least a portion of the first slot, the inner tines being attached to the spoon-shaped head above and below the first slot, and the inner surface of each tine having a longitudinal groove therein for guiding a plate;

(d) the plate movably positioned in the first slot, the plate (a) being capable of longitudinal movement between first and a second positions and (b) having two longitudinal, forward recesses there, each recess corresponding to an inner tine, wherein (i) in the first position an outer edge of the plate is proximate to the forward end of the head, the plate thereby substantially closing the cut out portion, the longitudinal groove in the inner surface of the tines forming a substantially liquid impervious seal with the plate, and the utensil thereby forming a spoon, and (ii) in the second position the outer edge of the plate is proximate the inner end of the cut out portion of the spoon-shaped head, the cut out portion of the spoon-shaped head thereby being substantially exposed, and the utensil thereby forming a fork; and (e) a tab for moving the plate between the first and second positions, the tab being attached to the plate and protruding from the second slot.

* * * * *